US006758336B2

(12) United States Patent
Kohana

(10) Patent No.: US 6,758,336 B2
(45) Date of Patent: Jul. 6, 2004

(54) STORAGE CASE

(75) Inventor: Norio Kohana, 37-2, Higashi Mizumoto 5-chome, Katsushika-ku, Tokyo 125-0032 (JP)

(73) Assignees: Norio Kohana, Tokyo (JP); Ohto Co., Ltd., Tokyo (JP)

( * ) Notice: Subject to any disclaimer, the term of this patent is extended or adjusted under 35 U.S.C. 154(b) by 233 days.

(21) Appl. No.: 10/148,891

(22) PCT Filed: Jan. 18, 2001

(86) PCT No.: PCT/JP01/00295

§ 371 (c)(1),
(2), (4) Date: Jun. 18, 2002

(87) PCT Pub. No.: WO01/54533

PCT Pub. Date: Aug. 2, 2001

(65) Prior Publication Data

US 2002/0179475 A1 Dec. 5, 2002

(30) Foreign Application Priority Data

Jan. 25, 2000 (JP) ..... 2000-015700
Feb. 18, 2000 (JP) ..... 2000-041484

(51) Int. Cl.[7] ..... B65D 85/00; B65D 85/57

(52) U.S. Cl. ..... 206/425; 206/307.1; 206/308.1; 229/67.3

(58) Field of Search ..... 206/425, 307.1, 206/308.1, 232, 39, 449; 40/124.2; 229/67.1, 67.3, 67.4

(56) References Cited

U.S. PATENT DOCUMENTS 1,596,661 A * 8/1926 Hutchings ..... 40/124.2
1,721,248 A 7/1929 Davis
4,444,314 A 4/1984 Jacobsson
4,589,544 A 5/1986 Schweinsberg
4,871,066 A 10/1989 LaWall
5,741,028 A * 4/1998 Hatano et al. ..... 229/67.1

FOREIGN PATENT DOCUMENTS

EP 0126980 12/1984
JP 61188982 11/1986

(List continued on next page.)

OTHER PUBLICATIONS

English Language Abstract of JP 61–188982.
English Language Abstract of JP 1–91789.
English Language Abstract of JP 62–99583.
English Language Abstract of JP 3–11831.
English Language Abstract of JP 7–308216.

*Primary Examiner*—Luan K. Bui
(74) *Attorney, Agent, or Firm*—Greenblum & Bernstein, P.L.C.

(57) ABSTRACT

According to the present invention, there is provided a storage including a plurality of unit cases each consisting of a front panel and rear panel, defining between them a pocket in which a content is received. In the storage case, the plurality of unit cases is coupled to each other with a coupling means formed in the rear panel of a forward one of adjacent unit cases and a one formed in the front panel of a rearward one so that the unit cases will be superposed on each other in the back-and-forth direction and the rearward one of the unit cases will be movable in a predetermined direction in relation to the forward one; each of the unit cases has a folding panel formed contiguously to, and along a return line at, the lower end of the rear panel; and the folding panel of the forward unit case is disposed in the pocket of the rearward unit case, namely, the front panel of the rearward unit case is disposed between the rear panel and folding panel of the forward unit panel. Thus, since a plurality of contents can be neatly received in place in the storage case, and contents can be introduced and taken out of the storage case more easily and positively, the storage case is most suitable for use to store or carry the plurality of contents. Further, since the storage case is simply constructed, it is suitable for mass production. Namely, the storage case can be manufactured at lower costs.

18 Claims, 13 Drawing Sheets

FOREIGN PATENT DOCUMENTS

| | | |
|---|---|---|
| JP | 62-99583 | 6/1987 |
| JP | 1-91789 | 6/1989 |
| JP | 3-11831 | 2/1991 |
| JP | 7-308216 | 11/1995 |
| TW | 320122 | 11/1997 |
| TW | 320123 | 11/1997 |

* cited by examiner

STORAGE CASE

FIELD OF THE INVENTION

The present invention generally relates to a file case or storage case for papers, drawings, tickets, certificates such as a car safety check card, health insurance card, passport and the like, catalogs, cards such as a credit card, cash card, telephone card and other prepaid cards, and recording media such as a CD, CD-ROM, FD, etc. More particularly, the present invention relates to a storage case adapted to neatly receive a plurality of contents and into and from which the content can be received and taken out more easily and positively than ever.

BACKGROUND ART

Conventional storage cases for papers, drawings, etc. have a plurality of partitions provided as appropriate inside the body thereof, for example.

Also, many storage cases are available which can receive a plurality of cards such as credit cards, cash cards and the like. They have formed therein a plurality of pockets vertically staggered from each other (in a multi-staged form), for example, and a card is received in each pocket with a part thereof being exposed.

However, many storage cases of such a conventional type having the plurality of partitions provided as appropriate therein are not advantageous in that any content such as papers or the like cannot be introduced or taken out easily and smoothly.

Also, in the storage case of the above-mentioned type having the plurality of vertically staggered pockets formed therein, a card is received in each of the multi-staged pockets with a part thereof being exposed. In case an increased number of such card pockets are formed, the cards and portions of the pockets receiving cards will have an increased area, which will make it difficult to design the storage case compact.

Accordingly, the present invention has a primary object to provide a storage case which overcomes the above-mentioned drawbacks of the prior art.

The present invention has another object to provide a storage case in which a plurality of contents can neatly be received in place and into and from which the contents can be introduced and taken out more easily and positively.

The present invention has still another object to provide a storage case most suitable for use to store or carry a content, and adapted to be operated smoothly or easier to handle when receiving and taking out the content.

The present invention has yet another object to provide a storage case having a simple construction and suitable for mass production. Thus it can be manufactured at lower costs.

DISCLOSURE OF THE INVENTION

The above object can be attained by providing a storage case, as recited in the claim 1, including a plurality of unit cases each consisting of a front panel and rear panel, defining between them a pocket in which a content is received, wherein:

the plurality of unit cases is coupled to each other with a coupling means formed in the rear panel of a forward one of adjacent unit cases and a one formed in the front panel of a rearward one so that the unit cases will be superposed on each other in the back-and-forth direction and the rearward one of the unit cases will be movable in a predetermined direction in relation to the forward one;

each of the unit cases has a folding panel formed contiguously to, and along a return line at, the upper end of the rear panel; and the folding panel of the forward unit case is disposed in the pocket of the rearward unit case and the front panel of the rearward unit case is disposed between the rear panel and folding panel of the forward unit panel.

In the storage case constructed as above, a plurality of contents can be neatly received in the pockets of the plurality of unit cases. Further, the plurality of unit cases can be superposed on each other for a high compactness of the storage case or rearward unit cases can easily be moved in relation to the mating forward ones to a multi-staged form permitting easy introduction or removal of the contents into or from the pockets. Thus, this storage case is most suitable for use to store or carry the plurality of contents. Further, since the storage case is simply constructed, it is suitable for mass production. Namely, the storage case can be manufactured at lower costs.

Just with the rearmost one of the plurality of unit cases moved in the predetermined direction, the remaining ones can be moved smoothly one after another in that direction to the multi-staged form, so that the contents received in the unit cases can be exposed partially in the multi-staged form. With the unit cases set in this multi-staged form, a desired one of the contents in the unit cases can easily be taken out or a content can easily be introduced into a desired one of the unit cases. Namely, the storage case can be used very conveniently.

More specifically, since the folding panel is formed contiguously to, and along a return line at, the upper end of the rear panel of each unit case, and the folding panel of the forward unit case is disposed in the pocket of the rearward unit case, namely, the front panel of the rearward unit case is disposed between the rear panel and folding panel of the forward unit panel, so a content to be received into the unit cases, respectively, will not possibly be introduced by mistake into a space between adjacent unit cases (between the rear panel of the forward unit case and front panel of the rearward unit case) but it can be received positively and easily in the pockets of the unit cases. That is, the contents will not possibly be introduced into other than the pocket of the unit case. Thus, the unit case or content itself may not possibly be damaged.

Further, the adjacent unit cases (rear panel of the forward unit case and front panel of the rearward unit case) can be disposed close to each other and prevented from being separated largely from each other, and so the coupling means will not be applied with any large force.

Also, the above object can be attained by providing a storage case, as recited in the claim 2, including a plurality of unit cases each consisting of a front panel and rear panel, defining between them a pocket in which a content is received, wherein:

the plurality of unit cases is coupled to each other with a coupling means formed in the rear panel of a forward one of adjacent unit cases and a one formed in the front panel of a rearward one so that the unit cases will be superposed on each other in the back-and-forth direction and the rearward one of the unit cases will be movable in a predetermined direction in relation to the forward one;

each of the unit cases has a folding panel formed contiguously to, and along a return line at, the upper end of the rear panel;

the folding panel of the forward unit case is disposed in the pocket of the rearward unit case and the front panel of the rearward unit case is disposed between the rear panel and folding panel of the forward unit panel; and the folding panel of the forward unit case and front panel of the rearward unit case are provided each with a sliding-engagement means allowing the rearward unit case to be moved in a predetermined direction in relation to the forward unit case.

In the storage case constructed as above, since the folding panel of the forward unit case and front panel of the rearward unit case are provided each with the sliding-engagement means which allows the rearward unit case to be moved in a predetermined direction in relation to the forward unit case, the folding panel of the forward unit case can be prevented from being easily disengaged from inside the pocket of the rearward unit case due to any external force suddenly applied, and the folding panel of the forward unit case can be disposed close to the front panel of the rearward unit case more positively.

Also, the above object can be attained by providing a variant of either of the aforementioned storage cases, as recited in the claim 3, further including a cover panel formed contiguously to the rear panel of the rearmost unit case and an engagement means formed in each of the cover panel and the front panel of the foremost unit case.

In the storage case constructed as above, when the plurality of unit cases A is superposed on each other, the cover panel can be engaged with the front panel of the foremost unit case to easily keep the unit cases superposed on each other and the opening of the pocket of each unit case is closed. Also, the cover panel can easily be pinched by fingers to move the rearmost unit case in the predetermined direction.

Also, the above object can be attained by providing a variant of either of the aforementioned storage cases, as recited in the claim 4, in which the coupling means for coupling the adjacent unit cases to each other includes right and left engagement pieces formed, by cutting each like a tongue-shaped piece in the front panel of the rearward unit case with a predetermined distance between them, and corresponding right and left engagement holes formed in the rear panel of the forward unit case with a predetermined distance between them, each of the engagement holes consisting of an upper hole and lower hole.

In the above storage case constructed as above, the coupling means for coupling the adjacent unit cases to each other are simply constructed. Thus, the storage case can be produced easily. Particularly, the coupling means permits to move the rearward and frontward ones of the adjacent unit cases more smoothly and stably in the predetermined direction and couple the adjacent unit cases to each other more positively.

Also, the above object can be attained by providing a variant of either of the aforementioned storage cases, as recited in the claim 5, in which the sliding-engagement means for engaging, by sliding, the folding panel of the forward unit case with the front panel of the rearward unit case includes an engagement piece formed, by cutting, like a tongue-shaped piece in the folding panel of the forward unit case and an engagement hole formed in the front panel of the rearward unit case, the engagement piece being slidably inserted into the engagement hole.

In the above storage case constructed as above, the sliding-engagement means can be constructed simply. Thus the storage case can be produced easily. Also, the sliding-engagement means permits to engage the folding panel of the forward unit case with the front panel of the rearward unit case more securely and simply and move the engagement piece smoothly in relation to the engagement hole. Further, the folding panel and front panel will not possibly be easily disengaged from each other with a sudden force applied.

Also, the above object can be attained by providing a storage case for use to store a plurality of relatively thin contents such as cards and recording media, as recited in the claim 6, including a main case open at one end and a plurality of unit cases each having a pocket to receive a content and which are to be housed in a superposed state in the main case, each of the unit cases including a front panel, a rear panel formed contiguously to, and along a return line at, the lower end of the front panel, and a folding panel formed contiguously to, and along the upper end of, the rear panel;

adjacent unit cases being coupled to each other with a coupling means formed in each of the front and rear panels of the unit case;

the folding panel being disposed inside the pocket of the rearward one of the adjacent unit cases while the front panel of the rearward unit case is caught between the rear and folding panels of the forward unit case;

the foremost unit case being engaged with the main case; and the plurality of unit cases being drawn out one after another from the opening of the main case, by pulling out the rearmost unit case, in an order from the rearward unit case preceding the rearmost one towards the foremost unit case.

In the storage case constructed as above, a plurality of contents can be received neatly in the pockets of the plurality of unit cases and the unit cases can be received in a superposed state into the main case. Thus a plurality of contents can be received compactly in the storage case. Also, since the storage case is simply constructed, it is suitable for mass production. Thus, it can be manufactured at lower costs.

Just by pulling out the rearmost unit case from the opening of the main case, the unit cases can be so drawn out smoothly one after another in an order from the rearward element case preceding the rearmost one towards the foremost unit case. Thus parts of the contents received in the unit cases, respectively, can be exposed in a multi-staged state, so a desired one of the contents received in the unit cases can easily be taken out or a content can easily be inserted into a desired one of the unit cases. Namely, the storage case can be used very conveniently.

More specifically, since each of the unit cases includes a front panel, a rear panel formed contiguously to, and along a return line at, the lower end of the front panel, and a folding panel formed contiguously to, and along the upper end of, the rear panel, adjacent unit cases are coupled to each other with a coupling means formed in each of the front and rear panels of the unit case and the folding panel is disposed inside the pocket of the rearward one of the adjacent unit cases while the front panel of the rearward unit case is caught between the rear and folding panels of the forward unit case, so a content to be received into the unit cases, respectively, will not possibly be introduced by mistake into spaces between adjacent unit cases (between the rear panel of the forward unit case and front panel of the rearward unit case) but it can be received positively and easily in the pockets of the unit cases. That is, the contents will not possibly be introduced into other than the pocket of the unit case. Thus, the unit case or content itself may not possibly be damaged.

Also, the above object can be attained by providing a variant of the aforementioned storage case, as recited in the claim 7, in which each of the unit cases is open at the upper edge and one lateral edge of the front panel, and also at the upper edge and one lateral edge of the rear panel.

In the storage case constructed as above, a content can very smoothly be inserted into, or taken out from, the pocket of the unit case.

Also, the above object can be attained by providing a variant of the aforementioned storage case, as recited in the claim 8, in which a tab is formed at the upper edge of the rear panel of the rearmost unit case.

In the storage case constructed as above, the tab allows an easy holding of the rearmost unit case and so the rearmost unit can easily be drawn out.

Also, the above object can be attained by providing a variant of the aforementioned storage cases, as recited in the claim 9, in which the coupling means for coupling the adjacent unit cases to each other includes right and left engagement pieces formed, by cutting each like a tongue-shaped piece in the front panel of the rearward unit case with a predetermined distance between them, and corresponding right and left engagement holes formed in the rear panel of the forward unit case with a predetermined distance between them, each of the engagement holes consisting of an upper hole and lower hole.

In the above storage case constructed as above, the coupling means for coupling the adjacent unit cases to each other are simply constructed. Thus, the storage case can be produced easily. Particularly, the coupling means permits to move the unit cases more smoothly and stably in the predetermined direction and couple the adjacent unit cases to each other more positively when drawing them out of the main case or introducing them in a superposed state into the main case.

These objects and other objects, features, and advantages of the present invention will become more apparent from the ensuing detailed description of the preferred embodiments of the present invention when taken in conjunction with the accompanying drawings. It should be noted that the present invention is not limited to the embodiments but can freely be modified without departing from the scope and spirit thereof defined in the claims given later.

BEST MODE FOR CARRYING OUT THE INVENTION

The present invention is directed to a file case or storage case designed to neatly receive a plurality of contents and into and from which the content can be received and taken out more easily and positively than ever, the contents including papers, drawings, tickets, certificates such as a car safety check card, health insurance card, passport and the like, catalogs, cards having a rectangular or other form such as a credit card, cash card, telephone card and other prepaid cards, and recording media such as a CD, CD-ROM, FD, etc.

There will be illustrated and described herebelow the first embodiment of the storage case according to the present invention with reference to FIGS. 1 to 9.

Figure 1:
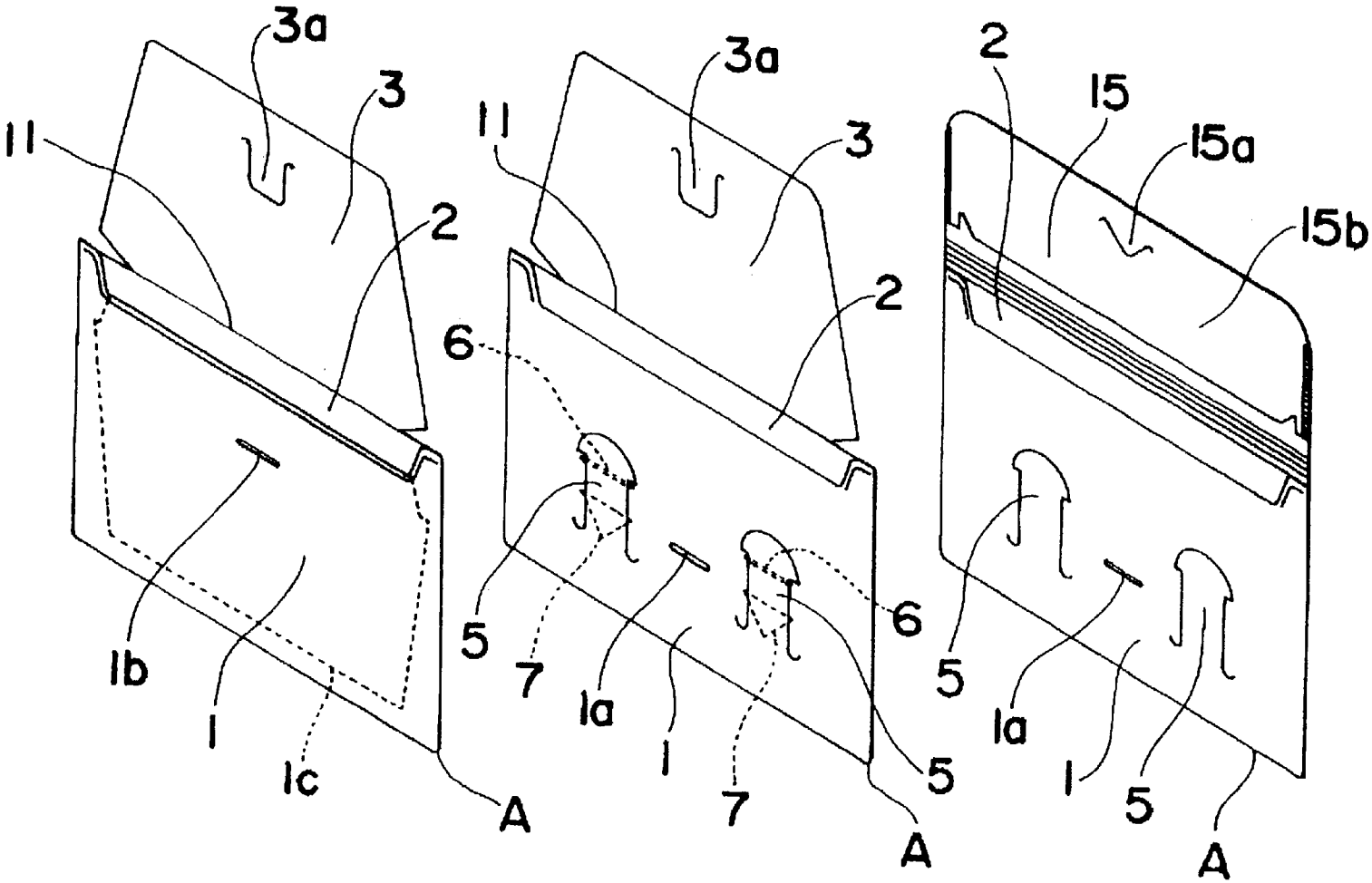
FIG. 1 is an exploded perspective view of a first embodiment of the storage case according to the present invention, showing only three unit cases of different types (foremost, interposed and rearmost) of a plurality of unit cases forming together the storage case.
Figure 2:
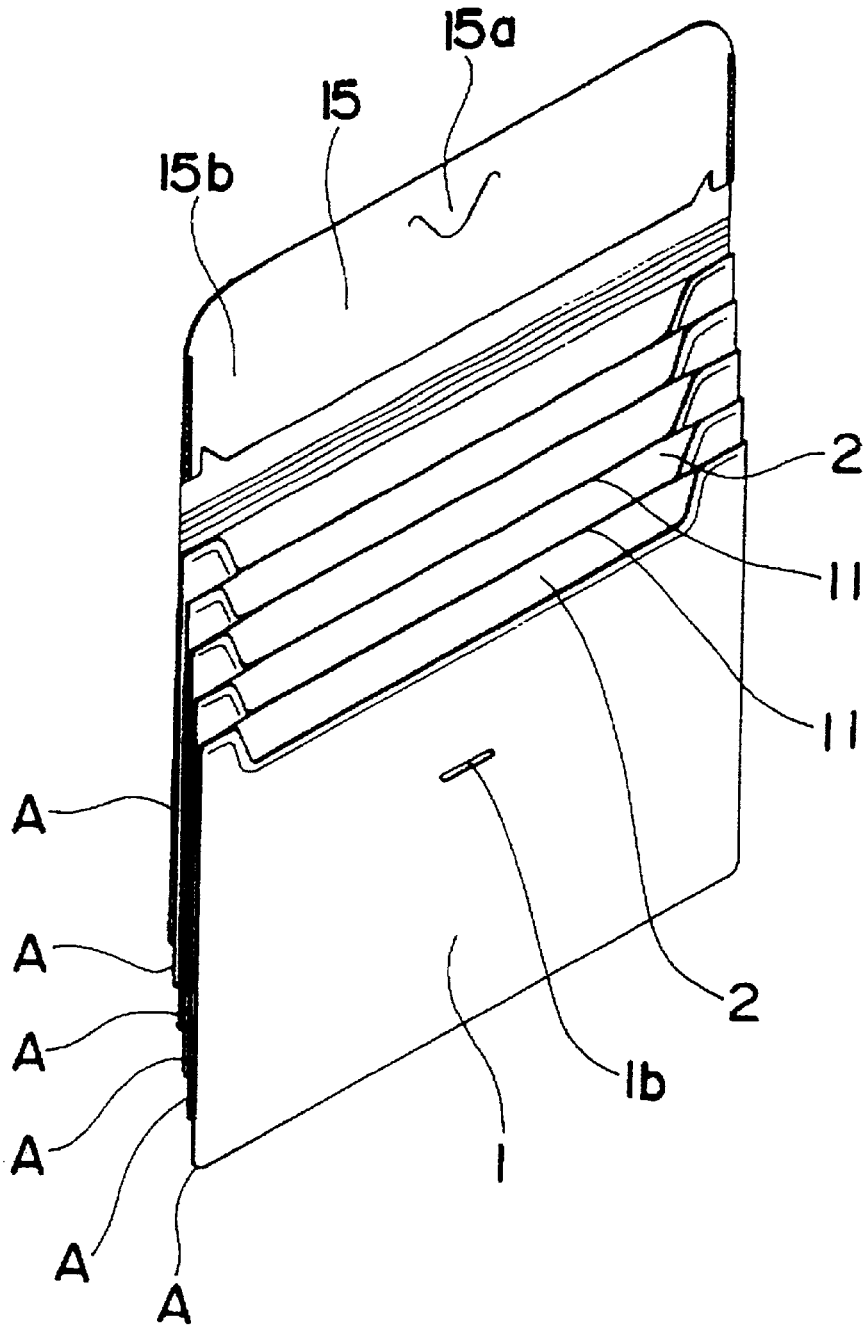
FIG. 2 is a perspective view of the first embodiment composed of six unit cases of which a rear one of adjacent cases is displaced in relation to a front one (in a multi-staged form).
Figure 3:
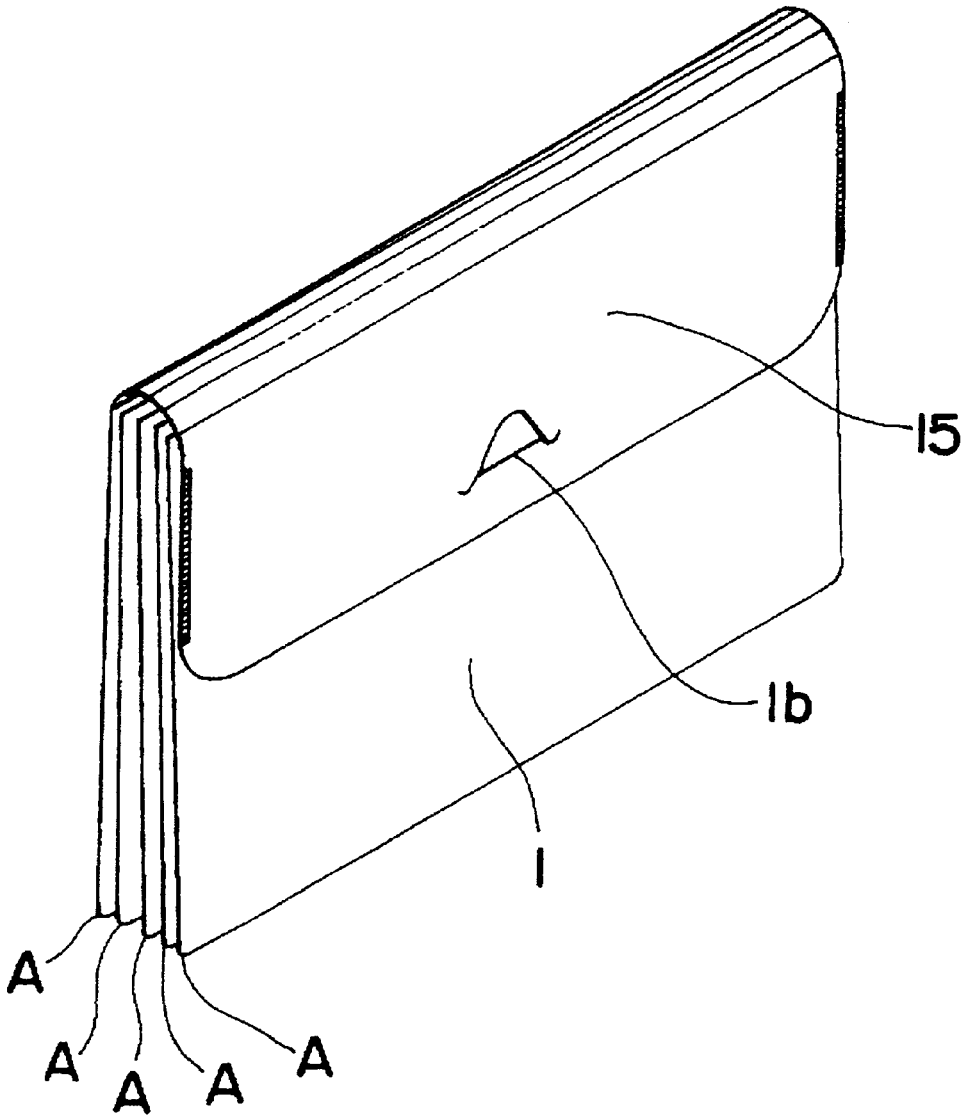
FIG. 3 is also a perspective view of the first embodiment composed of five unit cases superposed on each other with a cover panel being closed to, and engaged with, the foremost unit case.

As shown, the storage case according to the present invention is formed from a plurality of unit cases A each consisting of a front panel 1 and rear panel 2, defining between them a pocket in which the content C is received and which is open at the top end thereof. FIG. 1 shows only three basic types of unit case A (foremost, interposed and rearmost) included in the plurality of unit cases A forming together the storage case. FIG. 2 shows a storage case formed from six unit cases A. FIG. 3 shows a storage case formed from five unit cases A.

Figure 4:
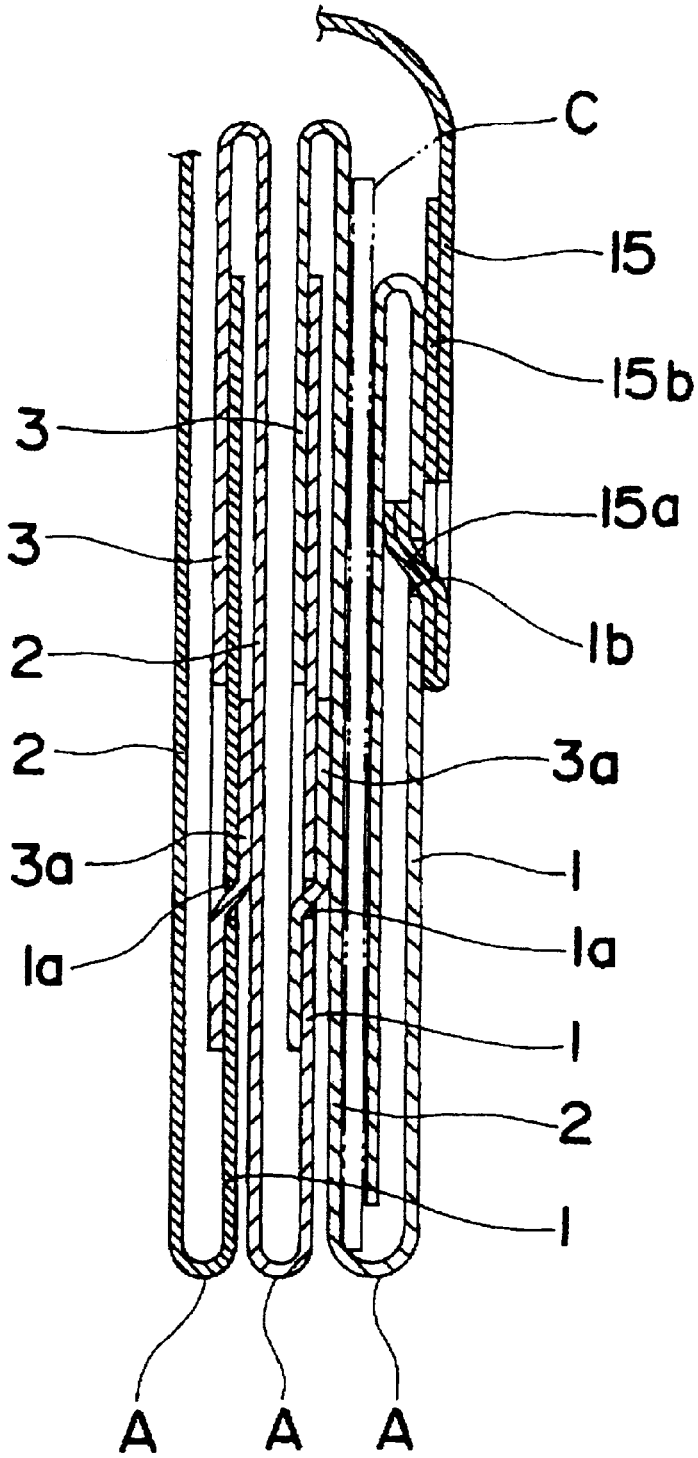
FIG. 4 is a fragmentary axial-sectional side elevation of the storage case in which the unit cases are coupled to each other.
Figure 5:
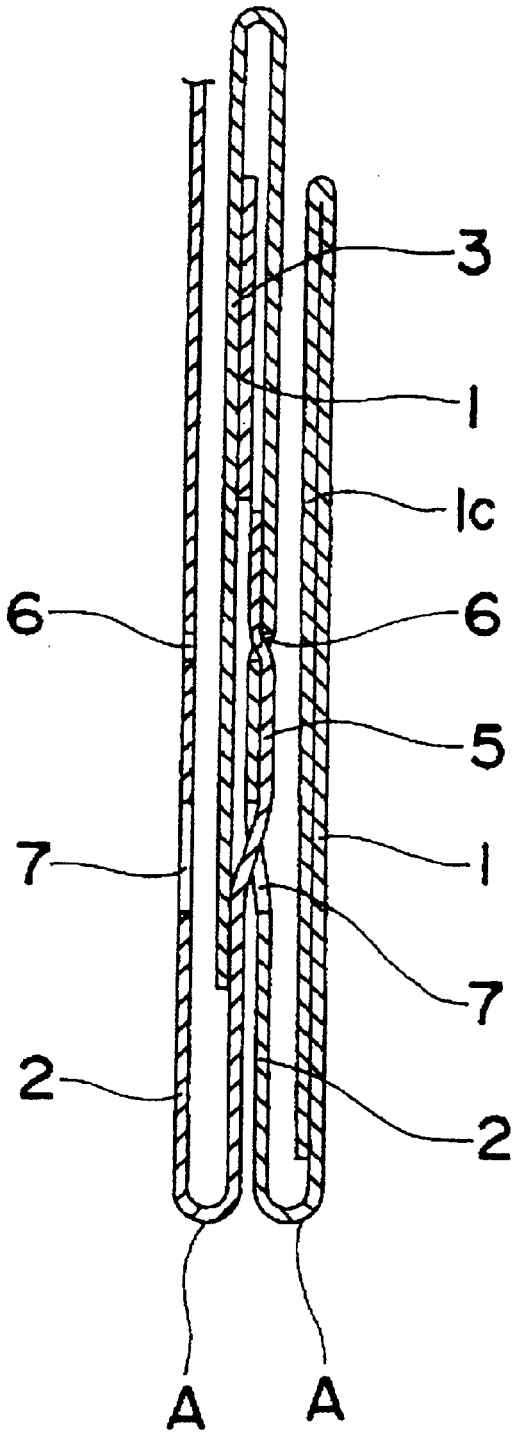
FIG. 5 is a fragmentary axial-sectional side elevation of the storage case, showing in further detail the mutual coupling between the unit cases shown in FIG. 4.
Figure 6:
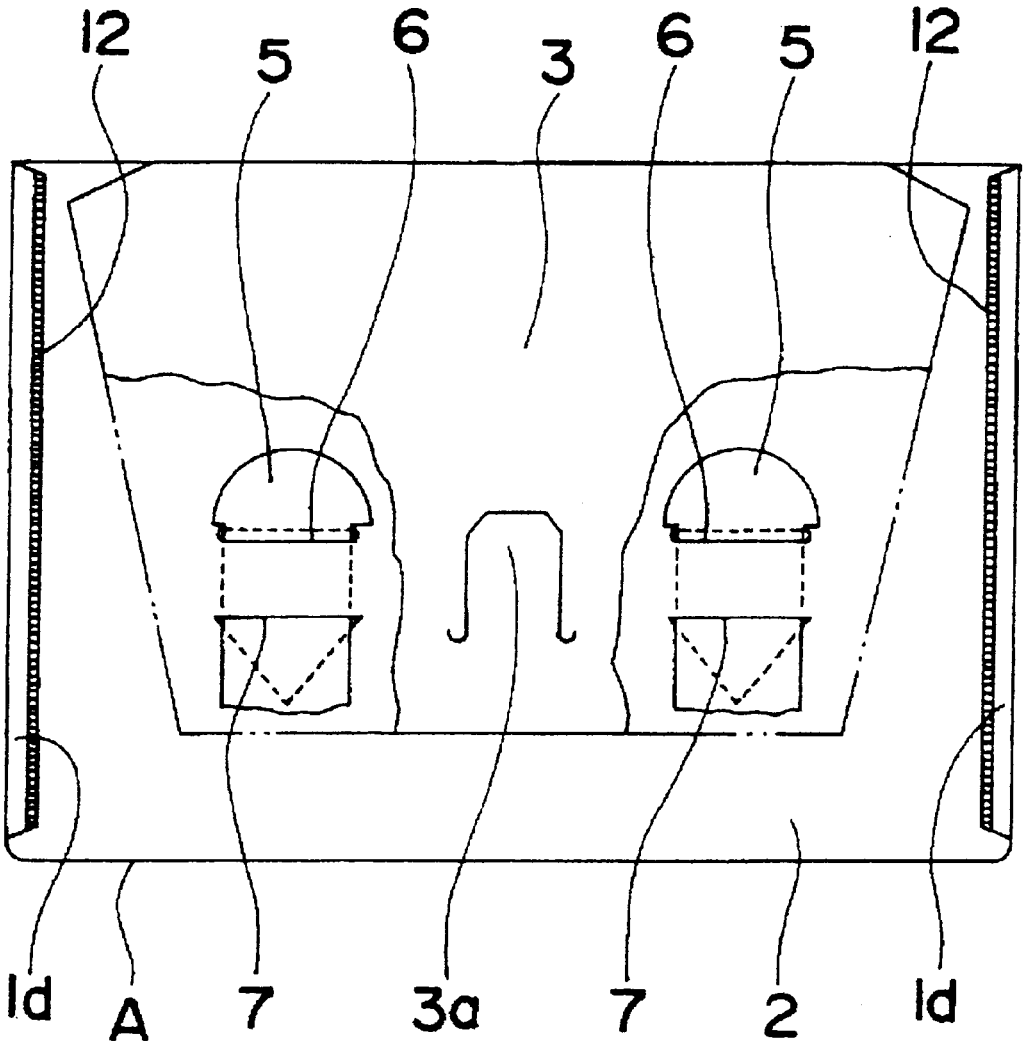
FIG. 6 is a partially cut-away rear view of the storage case, showing the mutual coupling between the unit cases in further detail.
Figure 7:
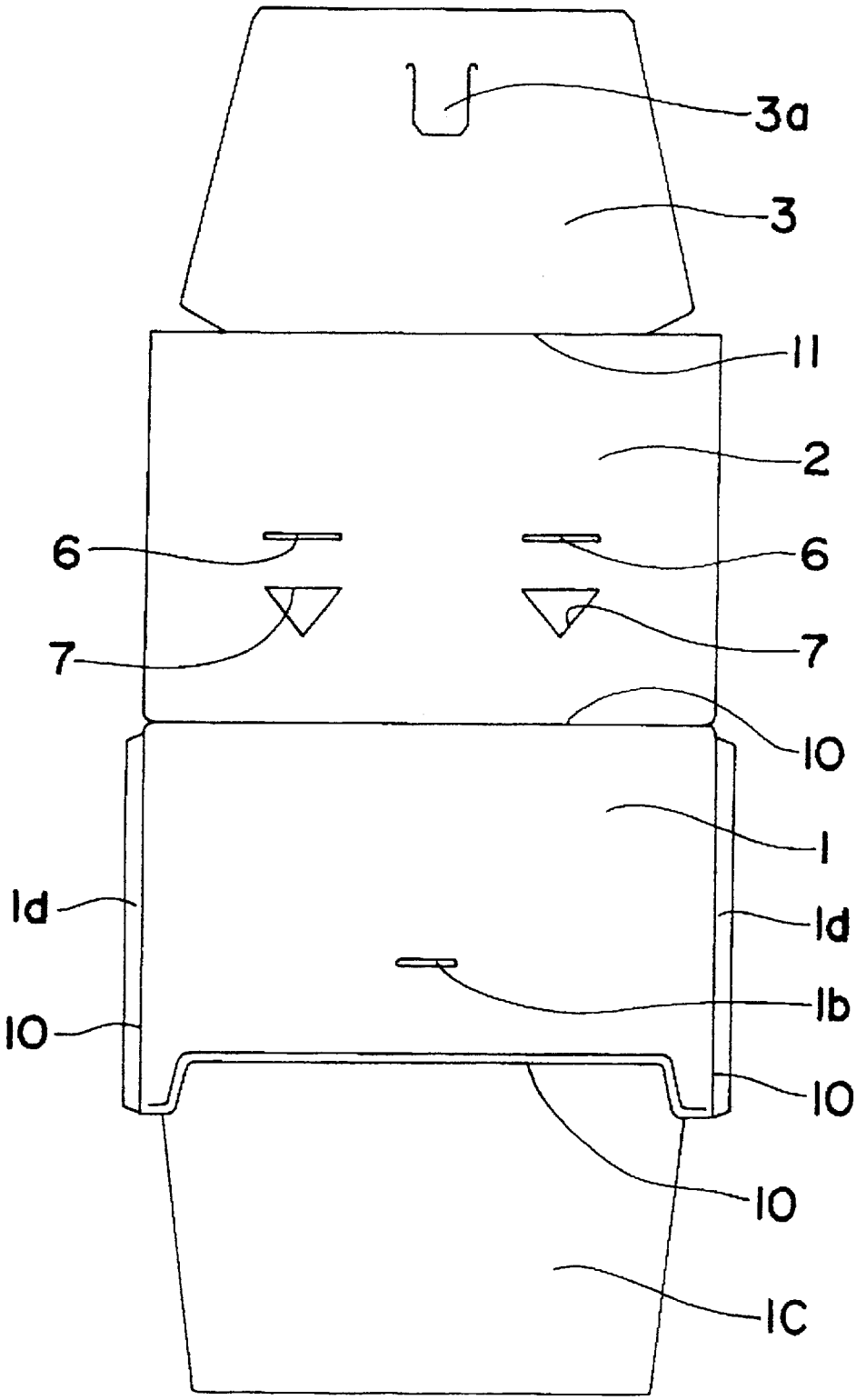
FIG. 7 is a development of the foremost unit case included in the storage case according to the second embodiment.
Figure 8:
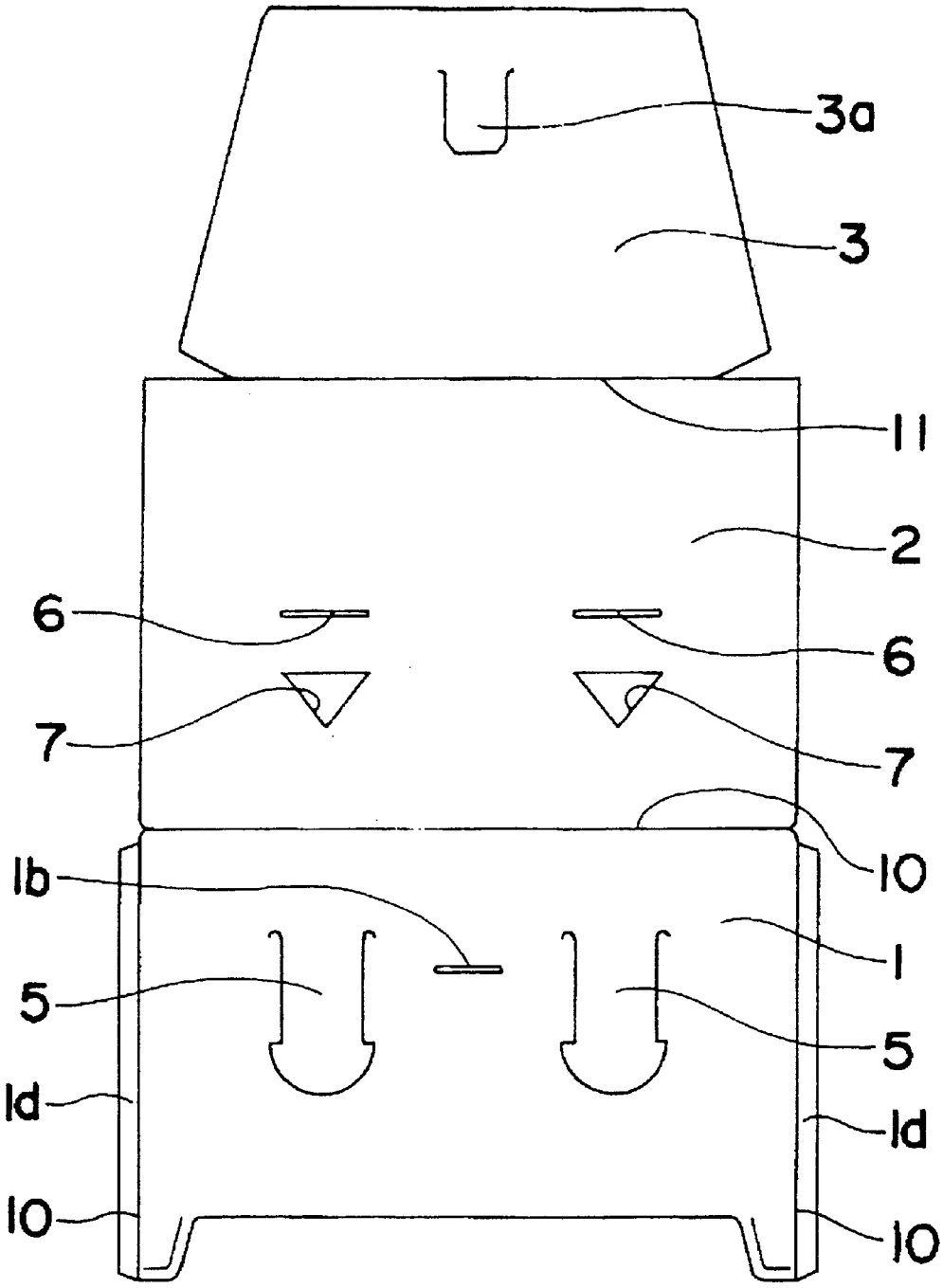
FIG. 8 is a development of the interposed unit case also included in the storage case.
Figure 9:
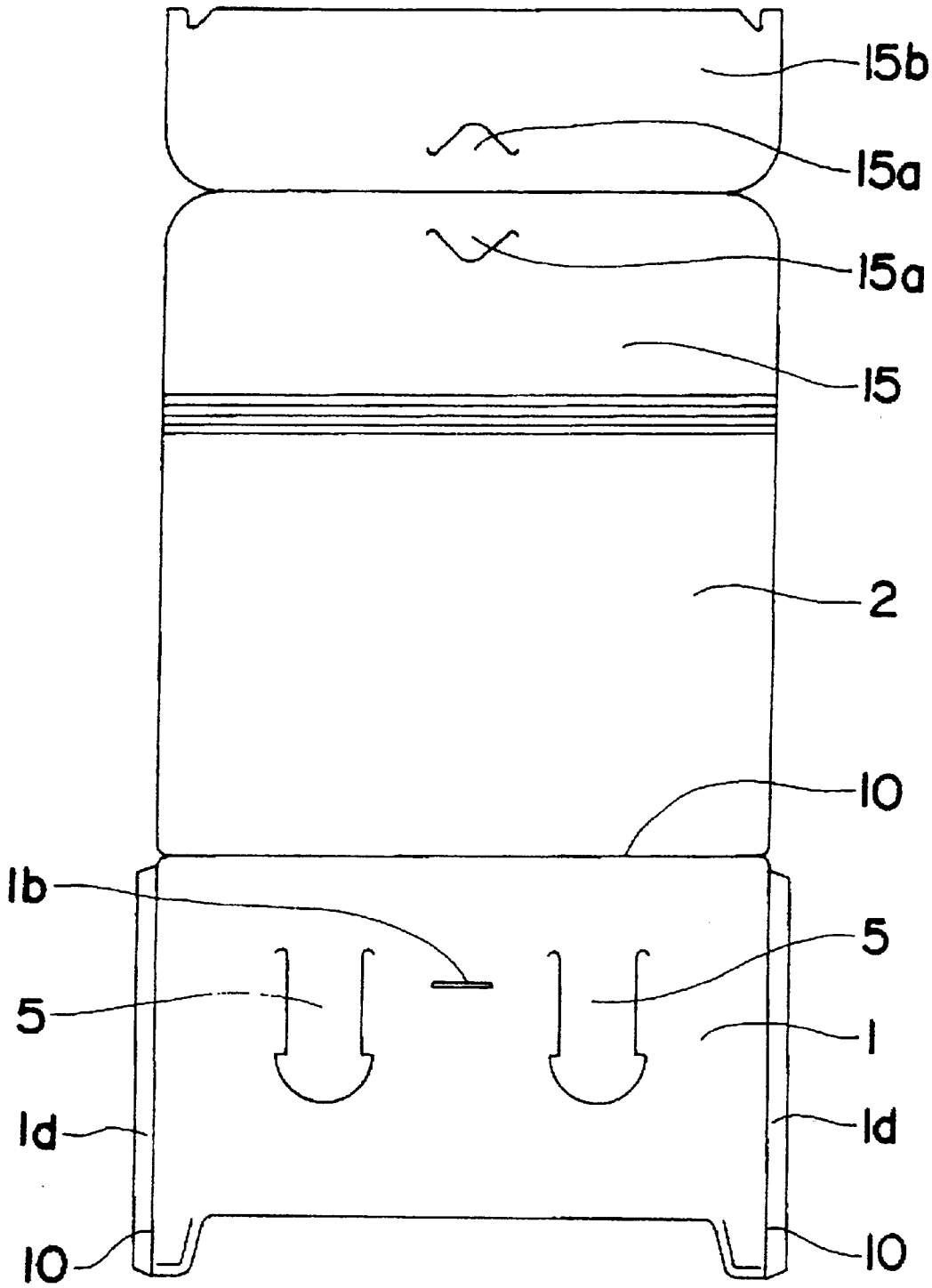
FIG. 9 is a development of the rearmost unit case also included in the storage case.

As best shown in FIGS. 4 and 5, the plurality of unit cases A included in the storage case is coupled to each other with a coupling means formed in the rear panel 2 of a forward one of adjacent unit cases A and a one formed in the front panel 1 of a rearward one so that the unit cases A will be superposed on each other in the back-and-forth direction and the rearward one of the unit cases A will be movable in a predetermined direction (normally, upward) in relation to the forward one. Also, each of the unit cases A has a folding panel 3 formed contiguously to, and along a return line 11 at, the upper end of the rear panel 2, the unit cases A are joined to each other, the folding panel 3 of the forward unit case A is disposed in the pocket of the rearward unit case A, and the front panel 1 of the rearward unit case A is disposed between the rear panel 2 and folding panel 3 of the forward unit panel A.

That is, the folding panel 3 covers the space between the adjacent unit cases A (space between the rear panel 2 of the forward unit panel A and the front panel 1 of the rearward unit panel A), and so the content C will not possibly be inserted into such a space. Thus, the content C will positively be received in the pocket of the unit case A.

Also, there is formed in the folding panel 3 of the forward unit case A and front panel 1 of the rearward unit case A a sliding engagement means to allow the rearward unit case A to be moved in a predetermined direction (upward, for example) in relation to the froward unit case A, as shown in FIG. 4. That is, the folding panel 3 of the forward unit case A will not be easily be disengaged from the pocket of the rearward unit case A under a suddenly applied force or the like.

Further, each of the unit cases A forming together the storage case has a generally rectangular form whose longer side is directed in the up-down direction, for example, and includes the foremost one, rearmost one and a desired number of ones interposed between the foremost and rearmost ones. The coupling means formed in the rear panel 2 of the foremost unit case A, front and rear panels 1 and 2 of the interposed unit cases A and in the front panel 1 of the rearmost unit case A, couple adjacent unit cases A to each other.

When the rearmost unit case A is moved in a predetermined direction (upward, for example), the plurality of interposed unit cases A is moved in the predetermined direction (upward in this case) one after another in an order from the rearward unit case A preceding the rearmost one A towards the foremost one A to a multi-staged form as shown in FIG. 2.

Note that the plurality of unit cases A coupled to each other can of course be set superposed on each other in the back-and-forth direction as shown in FIG. 3. It should also noted that the coupling means may be formed so that the plurality of unit cases A are movable in a predetermined direction such as right-left direction, oblique direction or circular direction, in addition to the up-down direction.

In addition, a cover panel 15 is formed contiguously to the rear panel 2 of the rearmost unit case A, and an appropriate engagement means is formed in the cover panel 15 and the front panel 1 of the foremost unit case A. That is, when the plurality of unit cases A is set in the superposed state, the cover panel 15 can be engaged with the front panel 1 of the foremost unit case A to positively keep the plurality of unit cases A in the superposed state and the opening of each unit case A is closed as shown in FIG. 3.

The unit case A is formed, in the form of a relatively thin sheet, from a synthetic resin, reinforced sheet of paper, metal sheet or other material, or a combination of such materials. For example, the unit case A is formed from, for example, the rear panel 2 having a generally rectangular form, and the front panel 1 formed contiguously to, and along a return line 10 at, the lower end of the rear panel 1. Each of the front and rear panels 1 and 2 has a marginal portion 1*d* formed contiguously to, and along either side, right and left, thereof. Each of the marginal portions 1*d* is turned over along a return line 13 inwardly and secured or welded at an edge 12 thereof to the rear panel 2, and so an opening is defined between the upper ends of the front and rear panels 1 and 2 thus secured to each other. Namely, the front and rear panels 1 and 2 form together an envelop structure. The front panel 1 is formed at the upper end thereof to have a cut whose general form is an inverted trapezoid. It is folded along a return line 14 at the upper end of the front panel 1. The inverted-trapezoidal cutting will allow smoother introduction or removal of a content C into or from the pocket of the unit case A. The above will be seen from FIG. 1.

Note that one of the lateral ends of the front and rear panels 1 and 2 may be formed open or the upper ends, and one of the lateral ends, of the front and rear panels 1 and 2 may be formed open. The return line 14 may be formed to have an appropriate width correspondingly to the thickness of a content C to be received in the pocket defined between the marginal portion 1*c* and rear panel 2 of the foremost unit case A.

The coupling means includes a pair of right and left engagement pieces 5 formed, by cutting, each like a tongue-shaped piece in the front panels 1 of the interposed unit cases A and in the front panel 1 of the rearmost unit case A, and also a corresponding pair of right and left engagement holes 6 and 7 formed in the rear panel 2 of the interposed unit cases A and in the rear panel 2 of the rearmost unit case A. The right and left engagement pieces 5 are spaced a predetermined distance from each other, and also the right and left engagement holes 6 and 7 are spaced the predetermined distance from each other. Further, the free end of each of the right and left engagement pieces 5 is formed to work as an anchor which prevents the engagement piece 5 from being easily disengaged from the engagement hole. The anchoring portion includes projections from the engagement piece 5 to the right and left, for example.

Each of the engagement holes includes two holes, upper and lower, that is, a horizontal slit 6 and an inverted triangular hole 7. As best shown in FIG. 5, the engagement piece 5 is first inserted into the lower hole (inverted triangular hole) 7 from outside the unit case A, passed inside the unit case A, and then inserted into the upper hole (slit) 6 to outside the unit case A.

Note that when the anchoring portion of the engagement piece 5 is engaged in the slit (upper hole) 6, the adjacent unit cases A are superposed on each other and when the base end of the engagement piece 5 come to the upper edge of the lower hole 7, the adjacent unit cases A are vertically offset one from the other over a longest distance.

The aforementioned sliding engagement piece consists of a generally rectangular engagement piece 3*a* formed like a tongue-shaped piece, by cutting, in the folding panel 3 of the forward unit case A, and a horizontal slit 1*a* formed in the front panel 1 of the rearward unit case A. The engagement piece 3*a* is slidably inserted into the horizontal slit 1*a*.

Note that the engagement piece 3*a* may have the free end thereof formed to work as an anchor which prevents the engagement piece 3*a* from being easily disengaged from the horizontal slit 1*a*. The anchoring portion includes projections from the engagement piece 3*a* to the right and left, for example. It should also noted that although the coupling means allows the folding panel 3 of the forward unit case A and front panel 1 of the rearward unit case A to be moved in relation to each other in the predetermined direction (up-down direction) as above, the coupling means may be formed so that the plurality of unit cases A are movable in a predetermined direction such as right-left direction, oblique direction or circular direction, in addition to the up-down direction.

The aforementioned engagement means consists of an engagement piece 15*a* formed like a V-shaped piece, by cutting, in the cover panel 15 formed contiguously to, and along the return line at, the upper end of the rear panel 2 of the rearmost unit case A, and a horizontal slit 1*b* formed in the upper middle of the front panel 1 of the foremost unit case A. The engagement piece 15*a* is engaged into the slit 1*b*.

Note that the engagement means may be a snap button, Velcro closure or any other connecting, adhesion or bonding means.

Further, in the foremost unit case A, the engagement pieces 5 and engagement hole 1*a* are not formed in the front panel 1 but a generally trapezoidal folding panel 1*c* is formed contiguously to, and along a return line 14 at, the upper end of the front panel. The folding panel 1*c* is folded closely to the inner side of the front panel 1.

Also, in the rearmost unit case A, no engagement hole is formed in the rear panel 2 but the cover panel 15 is formed contiguously to, and along a plurality of pleat lines at, the upper end of the rear panel 2.

Note that the cover panel 15 has a reinforcing panel 15*b* formed contiguously to the cover panel 15 itself to increase the strength and rigidity of the cover panel 15.

FIGS. 10 to 13 show together another embodiment of the storage case according to the present invention. This storage case includes a main case B open at one end, and a plurality of unit cases A each having a pocket to receive a content C, and which are to be housed together in a superposed state in the main case. The plurality of unit cases can be drawn out one after another from the opening of the main case, by pulling out the rearmost unit case, in an order from the rearward unit case preceding the rearmost one towards the foremost unit case in a multi-staged form.

Further, each of the unit cases A forming together the storage case has a generally rectangular form whose longer side is directed in the up-down direction, for example, and includes the foremost one, rearmost one and a desired number of ones interposed between the foremost and rearmost ones. A coupling means formed in the rear panel 2 of the foremost unit case A, front and rear panels 1 and 2 of the interposed unit cases A and in the front panel 1 of the rearmost unit case A, couple adjacent unit cases A to each other.

Figure 11:
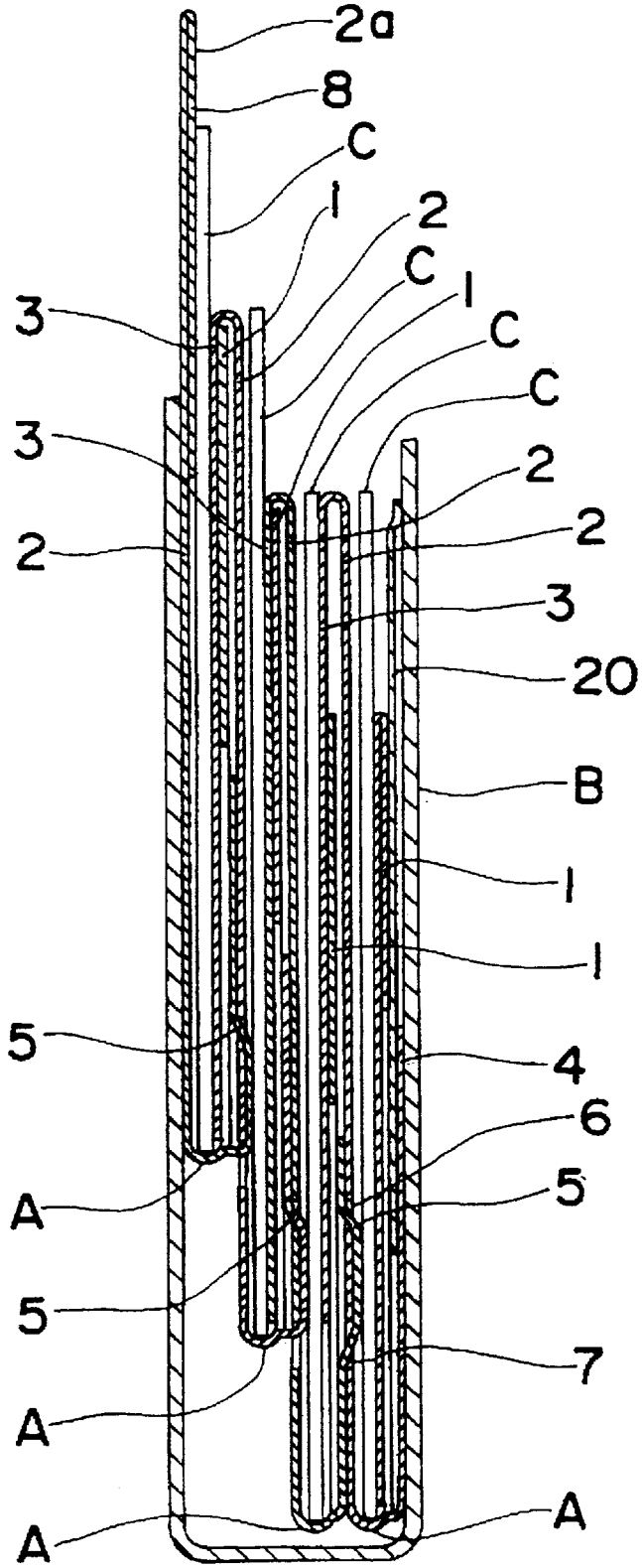
FIG. 11 is a partially cut-away axial-sectional side elevation of the second embodiment, showing the unit cases set in the storage case.
Figure 12:
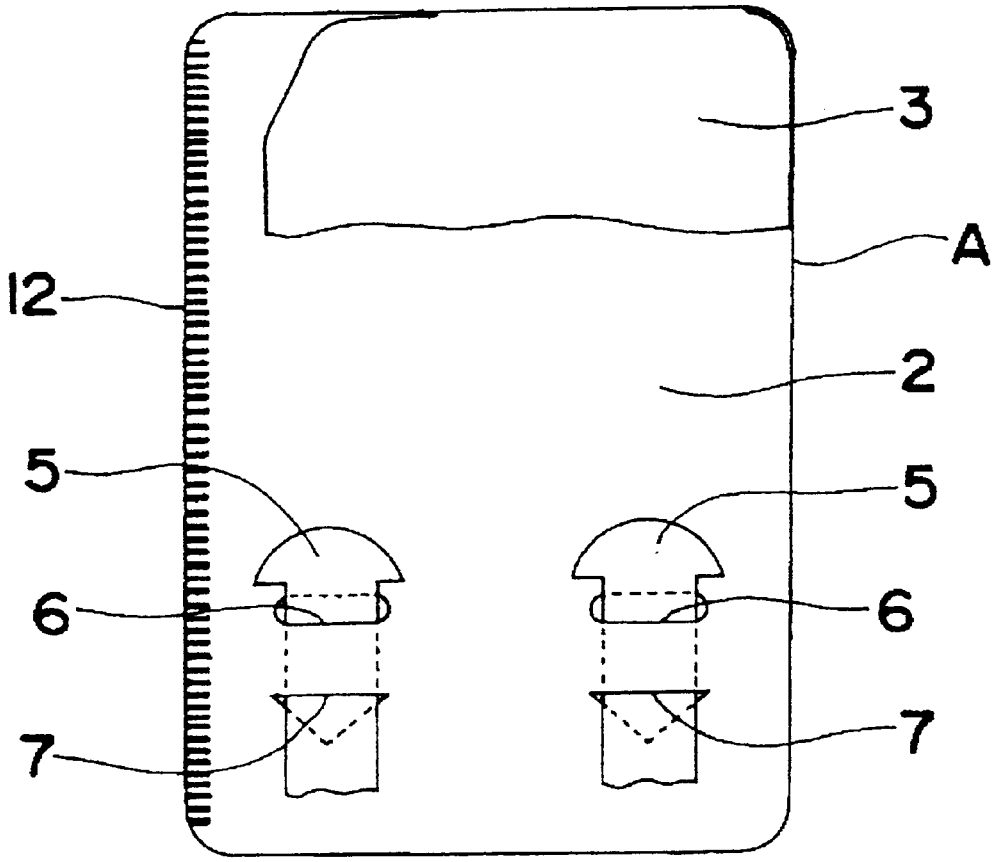
FIG. 12 is a partially cut-away rear view of the storage case, showing the mutual coupling between the unit cases.
Figure 13:
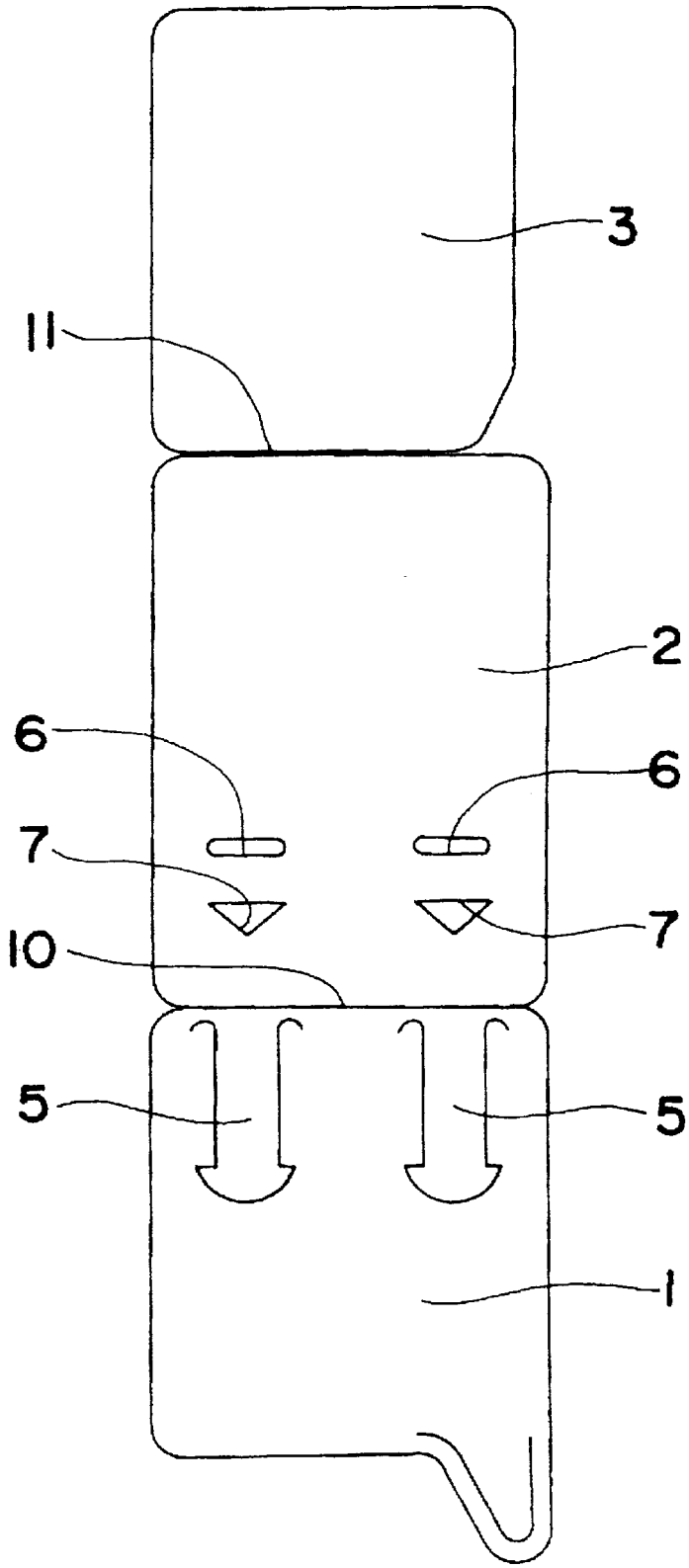
FIG. 13 is a development of an interposed unit case included in the storage case.

The foremost unit case A is engaged on the main case B. When the rearmost unit case A is moved in a predetermined direction (upward, for example), the plurality of interposed unit cases A is moved in the predetermined direction (upward in this case) one after another in an order from the rearward unit case A preceding the rearmost one A towards the foremost one A in a multi-staged form as shown in FIG. 11.

The unit case A is formed, in the form of a relatively thin sheet, from a synthetic resin, reinforced sheet of paper, metal sheet or other material, or a combination of such materials. For example, the unit case A is formed from, for example, the rear panel 2 having a generally rectangular form, and the front panel 1 formed contiguously to, and along a return line 10 at, the lower end of the rear panel 1. The front and rear panels 1 and 2 are secured or welded at one lateral edges 12 thereof to each other, and so a pocket thus formed between the front and rear panels 1 and 2 is open at the upper ends and the other lateral sides of the front and rear panels 1 and 2. The front panel 1 is formed at the upper end thereof nearer like to have a cut whose general form is an inverted trapezoid. The inverted-trapezoid cutting will allow smoother introduction or removal of a content C into or from the pocket of the unit case A as shown in FIG. 10.

Each of the foremost unit case A and interposed unit case A has a generally rectangular folding panel 3 formed contiguously to, and along a return line 11 at, the upper end of the rear panel 2. The folding panel 3 is folded and housed in the pocket of a rear adjacent unit case A so that the front panel 1 of the rearward adjacent unit case A is disposed between the folding panel 3 and the rear panel 2 of the unit case A before the unit case A to which the folding panel 3 belongs. That is, the folding panel 3 will cover the space between adjacent unit cases A (rear panel 2 of the forward unit case A and front panel 1 of the rearward unit case A), and so a content C to be received into each unit case A will not possibly be introduced by mistake into that space but it can be received positively and easily in the pocket of the unit case A.

Note that the coupling means is the same as the one employed in the first embodiment having previously been described with reference to FIGS. 1 to 9.

Figure 10:
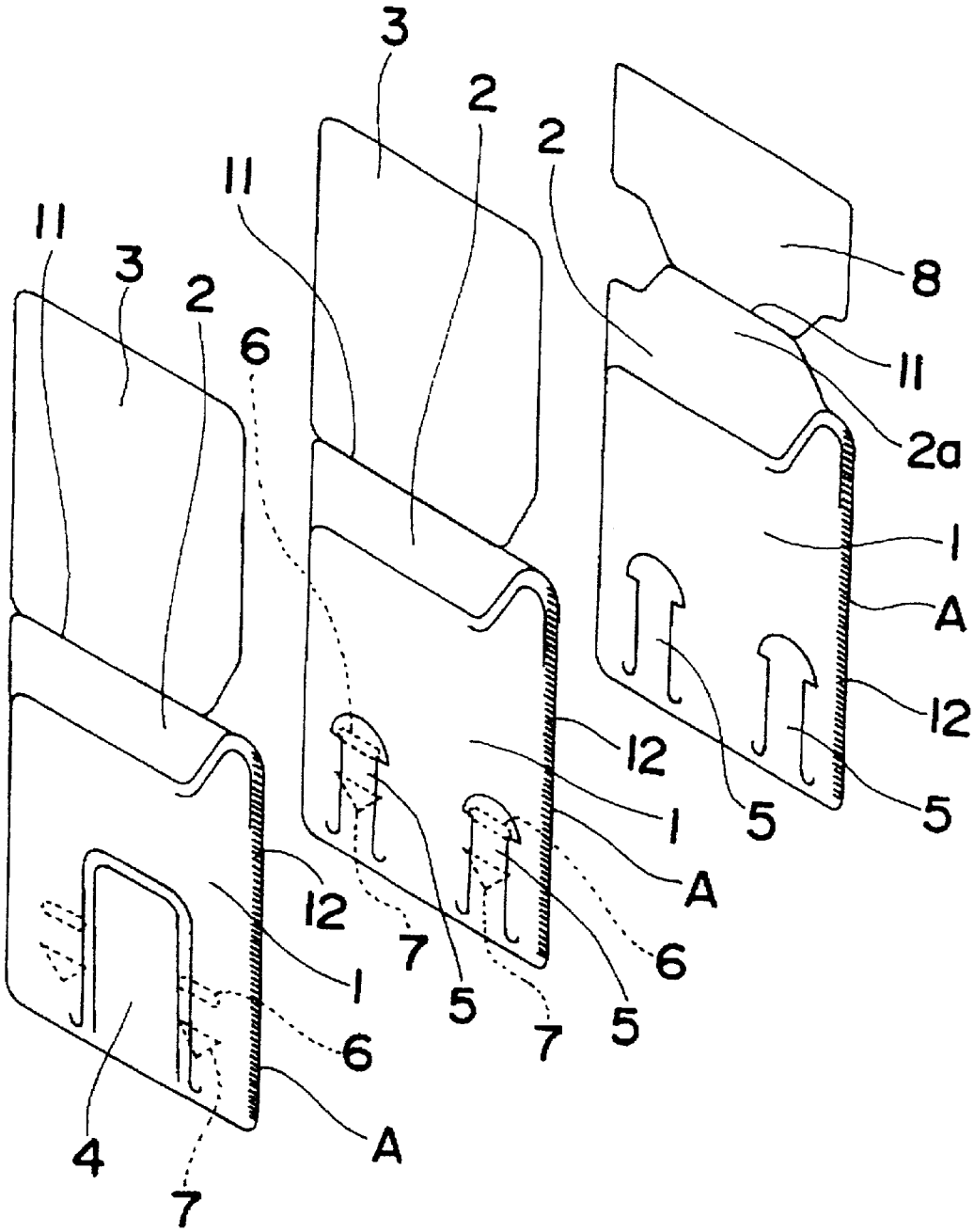
FIG. 10 is an exploded perspective view of a second embodiment of the storage case according to the present invention, showing only three unit cases of different types (foremost, interposed and rearmost) of a plurality of unit cases forming together a part of the storage case.

As shown, the foremost unit case A has a generally rectangular engagement piece 4 formed like a tongue-shaped piece, by cutting, in the central lower portion of the front panel 1 thereof as shown in FIG. 10. The engagement piece 4 is engaged at the base end thereof on the lower end of an engagement piece 20 of formed inside the main case B as shown in FIG. 11. Also, the generally rectangular folding panel 3 formed contiguously to, and the return line 11 at, the upper end of the front panel 1 of the unit case A, is disposed close to the inner surface of the front panel 1.

The rearmost unit case A has not any engagement holes formed in the rear panel 2 thereof but it has a generally rectangular tab 2*a*. The tab 2*a* is dimensioned for easy pinching by fingers. The rearmost unit case A can be drawn easily by pinching and pulling the tab 2*a*. Further, the rear panel 2 of the rearmost unit case A is extended at the upper end by a folding panel 8 formed contiguously to, and along a return line 11 at, the upper end. The folding panel 8 is disposed close to the inner surface of the rear panel 2 of the unit case A. Thus, the tab 2*a* is easier to pinch by fingers and increased in strength.

The main case B may be made from a leather, synthetic leather, synthetic resin, reinforced paper, metal sheet, any other appropriate material or a combination of such materials, and it may be formed like a purse open at the top thereof or like a commutation ticket case. Also, the engagement piece 20 is fixed to the upper portion of the inner side of the front panel 1 of the main case B, and the engagement piece 4 formed in the front panel 1 of the foremost unit case A can be engaged with the engagement piece 20.

Note that the engagement piece 20 is formed to block further draw-out of the foremost unit case A having been drawn out until the opening of the latter comes to just above the opening of the main case B. Also, the main case B may be formed so that the opening thereof can be closed.

Note that the construction, shape, dimensions, material of the storage case, construction, shape, dimensions, material and number of unit cases A, construction, shape, dimensions and material of the front panel 1, construction, shape, dimensions, location and number of the engagement hoes 1*a*, construction, shape, dimensions, location and number of the engagement hoes 1*b*, construction, shape, dimensions and material of the folding panel 1*c*, construction, shape, dimensions and material of the material portion 1*d*, construction, shape, dimensions and material of the rear panel 2, construction, shape and dimensions of the tab 2*a*, construction, shape, dimensions and position, of the contiguity to the rear panel 2, of the folding panel 3, construction, shape, dimensions and material of the engagement piece 3*a*, construction, shape, dimensions and location of the engagement piece 4, construction, shape, dimensions, material, number and location of the engagement piece 5, construction, shape, dimensions, number and location of the engagement holes, construction, shape, dimensions and location of the engagement hole 6, construction, shape, dimensions and location of the engagement hole 7, construction, shape, dimensions and material of the folding panel 8, construction, shape and dimensions of the return line 10, construction, shape and dimensions of the return line 11, construction and shape of the welded edge 12, construction, shape, dimensions and material of the cover panel 15, construction, shape, dimensions and location of the engagement piece 15*a*, construction, shape, dimensions and material of the reinforcing panel 15*b*, construction, shape, dimensions and material of the main case B, construction, shape, dimensions and material of the engagement piece 20, construction of the coupling means, construction of the sliding engagement piece, construction of the engagement piece and the other are not limited to those having been illustrated and described but may be set or varied freely without departing from the scope defined by the claims given later.

INDUSTRIAL APPLICABILITY

As having been described in the foregoing, the storage case according to the present invention can receive contents such as papers, drawings, tickets, certificates, catalogs, cards, or recording media such as a CD etc. Since a plurality of contents can be neatly received in place in the storage case and can be introduced and taken out of the storage case more easily and positively, the storage case is most suitable for use to store or carry the plurality of contents. Further, since the storage case is simply constructed, it is suitable for mass production. Namely, the storage case can be manufactured at lower costs.

What is claimed is:

1. A storage case including a plurality of unit cases each consisting of a front panel and rear panel, defining between them a pocket in which a content is received, wherein:

the plurality of unit cases is coupled to each other with a coupling means formed in the rear panel of a forward one of adjacent unit cases and a one formed in the front panel of a rearward one so that the unit cases will be superposed on each other in the back-and-forth direction and the rearward one of the unit cases will be movable in a predetermined direction in relation to the forward one;

the coupling means including right and left engagement pieces formed, by cutting, each like a tongue-shaped piece in the front panel of the rearward unit case with a predetermined distance between them, and corresponding right and left engagement holes formed in the rear panel of the forward unit case with a predetermined distance between them, each of the unit cases has a folding panel formed contiguously to, and along a return line at, the upper end of the rear panel; and the folding panel of the forward unit case is disposed in the pocket of the rearward unit case and the front panel of the rearward unit case is disposed between the rear panel and folding panel of the forward unit panel.

2. The storage case according to claim 1, wherein a cover panel formed contiguously to the rear panel of the rearmost unit case and an engagement means formed in each of the cover panel and the front panel of the foremost unit case.

3. The storage case according to claim 1, wherein each of the right and left engagement holes, formed corresponding to the right and left engagement pieces, consist of an upper hole and lower hole.

4. The storage case according to claim 2, wherein the sliding-engagement means for engaging, by sliding, the folding panel of the forward unit case with the front panel of the rearward unit case includes an engagement piece formed, by cutting, like a tongue-shaped piece in the folding panel of the forward unit case and an engagement hole formed in the front panel of the rearward unit case, the engagement piece being slidably inserted into the engagement hole.

5. The storage case according to claim 3, wherein the sliding-engagement means for engaging, by sliding, the folding panel of the forward unit case with the front panel of the rearward unit case includes an engagement piece formed, by cutting, like a tongue-shaped piece in the folding panel of the forward unit case and an engagement hole formed in the front panel of the rearward unit case, the engagement piece being slidably inserted into the engagement hole.

6. A storage case for use to store a plurality of relatively thin contents such as cards and recording media, comprising:

a main case open at one end; and a plurality of unit cases each having a pocket to receive a content is received, and which are to be housed in a superposed state in the main case;

each of the unit cases including a front panel, a rear panel formed contiguously to, and along a return line at, the lower end of the front panel, and a folding panel formed contiguously to, and along the upper end of, the rear panel;

adjacent unit cases being coupled to each other with a coupling means including right and left engagement pieces formed, by cutting, each like a tongue-shaped piece in the front panel of the rearward unit case with a predetermined distance between them, and corresponding right and left engagement holes formed in the rear panel of the forward unit case with a predetermined distance between them;

the folding panel being disposed inside the pocket of the rearward one of the adjacent unit cases while the front panel of the rearward unit case is caught between the rear and folding panels of the forward unit case;

the foremost unit case being engaged with the main case; and the plurality of unit cases being drawn out one after another from the opening of the main case, by pulling out the rearmost unit case, in an order from the rearward unit case preceding the rearmost one towards the foremost unit case.

7. The storage case according to claim 6, wherein each of the unit cases is open at the upper edge and one lateral edge of the front panel, and also at the upper edge and one lateral edge of the rear panel.

8. The storage case according to claim 6, wherein a tab is formed at the upper edge of the rear panel of the rearmost unit case.

9. The storage case according to claim 6, wherein each of the right and left engagement holes, formed corresponding to the right and left engagement pieces, consist of an upper hole and lower hole.

10. The storage case according to claim 7, wherein a tab is formed at the upper edge of the rear panel of the rearmost unit case.

11. The storage case according to claim 7, wherein each of the right and left engagement holes, formed corresponding to the right and left engagement pieces, consist of an upper hole and lower hole.

12. The storage case according to claim 8, wherein each of the right and left engagement holes, formed corresponding to the right and left engagement pieces, consist of an upper hole and lower hole.

13. The storage case according to claim 10, wherein each of the right and left engagement holes, formed corresponding to the right and left engagement pieces, consist of an upper hole and lower hole.

14. A storage case including a plurality of unit cases each consisting of a front panel and rear panel, defining between them a pocket in which a content is received, wherein:

the plurality of unit cases is coupled to each other with a coupling means formed in the rear panel of a forward one of adjacent unit cases and a one formed in the front panel of a rearward one so that the unit cases will be superposed on each other in the back-and-forth direction and the rearward one of the unit cases will be movable in a predetermined direction in relation to the forward one;

the coupling means including right and left engagement pieces formed, by cutting, each like a tongue-shaped piece in the front panel of the rearward unit case with a predetermined distance between them, and corresponding right and left engagement holes formed in the rear panel of the forward unit case with a predetermined distance between them, each of the unit cases has a folding panel formed contiguously to, and along a return line at, the upper end of the rear panel;

the folding panel of the forward unit case is disposed in the pocket of the rearward unit case and the front panel of the rearward unit case is disposed between the rear panel and folding panel of the forward unit panel; and the folding panel of the forward unit case and front panel of the rearward unit case are provided each with a sliding-engagement means allowing the rearward unit case to be moved in a predetermined direction in relation to the forward unit case.

15. The storage case according to claim 14, wherein a cover panel formed contiguously to the rear panel of the rearmost unit case and an engagement means formed in each of the cover panel and the front panel of the foremost unit case.

16. The storage case according to claim 14, wherein each of the right and left engagement holes, formed corresponding to the right and left engagement pieces, consist of an upper hole and lower hole.

17. The storage case according to claim 15, wherein the sliding-engagement means for engaging, by sliding, the folding panel of the forward unit case with the front panel of the rearward unit case includes an engagement piece formed, by cutting, like a tongue-shaped piece in the folding panel of the forward unit case and an engagement hole formed in the front panel of the rearward unit case, the engagement piece being slidably inserted into the engagement hole.

18. The storage case according to claim 16, wherein the sliding-engagement means for engaging, by sliding, the folding panel of the forward unit case with the front panel of the rearward unit case includes an engagement piece formed, by cutting, like a tongue-shaped piece in the folding panel of the forward unit case and an engagement hole formed in the front panel of the rearward unit case, the engagement piece being slidably inserted into the engagement hole.

* * * * *